United States Patent [19]

Phillips

[11] 4,274,796

[45] Jun. 23, 1981

[54] MACHINE COMPRISING A ROTATABLE BOOM ASSEMBLY

[75] Inventor: Raymond J. Phillips, Matlock, England

[73] Assignee: Alexander Shand Services Limited, Matlock, England

[21] Appl. No.: 26,961

[22] Filed: Apr. 4, 1979

[51] Int. Cl.[3] ..... E02F 5/00

[52] U.S. Cl. ..... 414/690; 414/694; 414/718; 414/735

[58] Field of Search ..... 414/680, 685, 694, 722, 414/728, 735, 738, 690, 718

[56] References Cited

U.S. PATENT DOCUMENTS

| | | | |
|---|---|---|---|
| 3,087,636 | 4/1963 | Weaver | 414/685 X |
| 4,062,455 | 12/1977 | Flatau | 414/735 |

*Primary Examiner*—Robert W. Saifer

*Assistant Examiner*—Terrance L. Siemens

*Attorney, Agent, or Firm*—Sughrue, Rothwell, Mion, Zinn and Macpeak

[57] ABSTRACT

A machine comprising a rotatable telescopic boom assembly includes an outer boom section, an intermediate boom section rotatably mounted within the outer boom section, and an inner boom section located within the intermediate boom section on a telescopic relationship thereto. The inner boom section is adapted to carry an implement such as, for example, an impact hammer, at one end thereof. A mounting is provided to which the outer boom section is rigidly attached. Fluid actuating means are also provided for rotatably driving the intermediate boom section within the outer boom section continuously through 360° in one direction of rotation and for reciprocating the inner boom section within the intermediate boom section.

12 Claims, 4 Drawing Figures

II
17
16
15
14
12
10
33
23
30
22
13
19
18
11

32
10
13
11
18
32
18

30
32
19
21
25
24
12
10
33
14
28
15
29
34
23
13
20
22
18
18

MACHINE COMPRISING A ROTATABLE BOOM ASSEMBLY

The present invention relates to a machine comprising a rotatable telescopic boom assembly, to which assembly may be attached various implements.

Machines are known comprising rotatable telescopic boom assemblies but the booms of these machines are not completely rotational throughout 360°. Hence, these booms cannot be continuously rotated in one direction for any length of time but must be oscillated first in one direction and then the other during use.

The object of the present invention is to provide a machine comprising a rotatable telescopic boom assembly in which the boom can be continuously rotated in any one direction.

According to the present invention there is provided a machine comprising a rotatable telescopic boom assembly including an outer boom section, an intermediate boom section rotatably mounted within the outer boom section, and an inner boom section located within the intermediate boom section in a telescopic relationship thereto and adapted to carry an implement at one end thereof; a mounting to which the outer boom section is rigidly attached; and fluid pressure actuating means for rotatably driving the intermediate boom section within the outer boom section continuously through 360° in one direction of rotation and for reciprocating the inner boom section within the intermediate boom section.

Preferably, the fluid pressure actuating means comprise a fluid motor linked to a gear box for rotatably driving the intermediate boom section and a first ram for reciprocating the inner boom section.

An example of the present invention will now be described with reference to the accompanying drawings in which.

Figures 1, 2, 3:
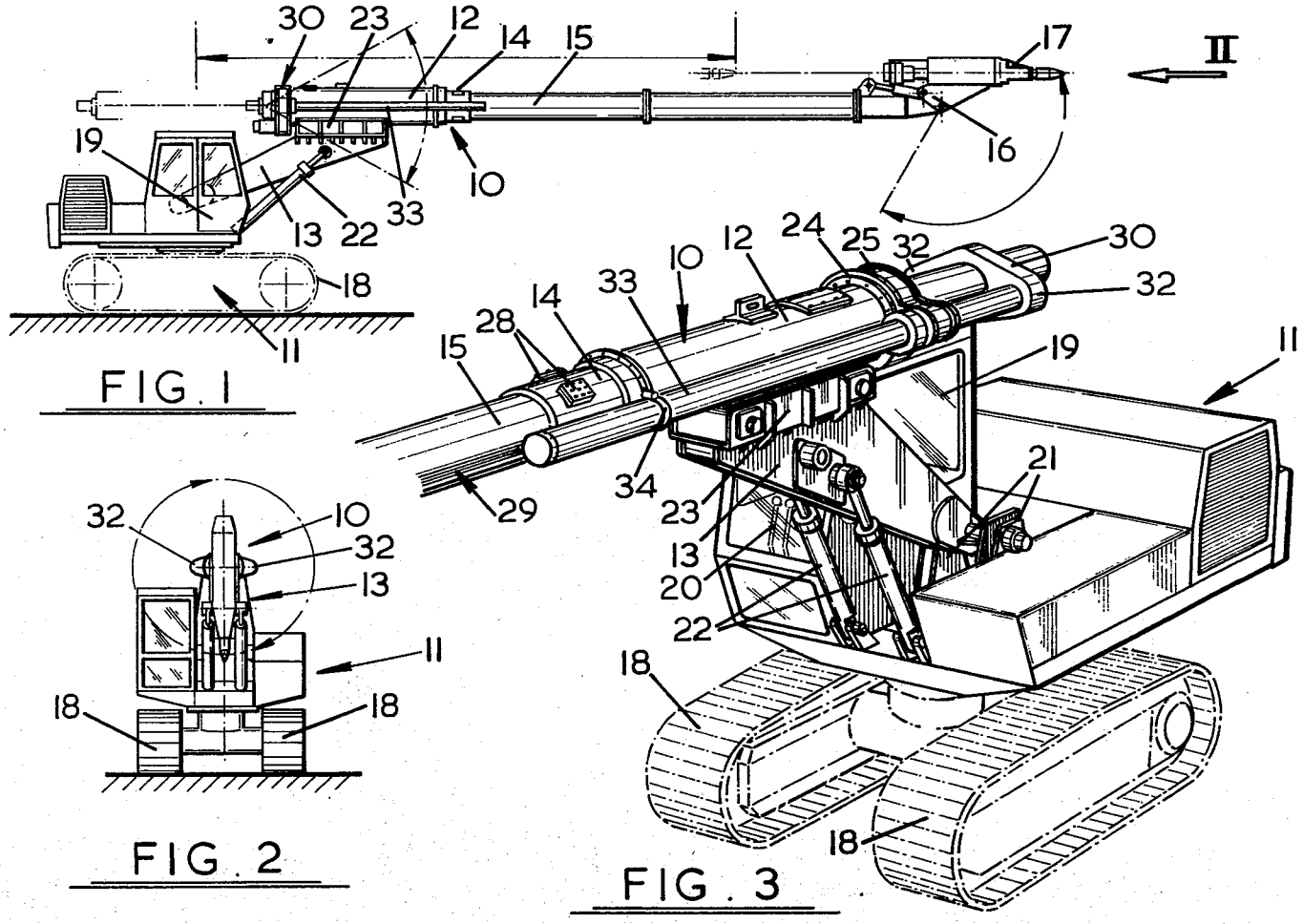
FIG. 1 is a schematic elevation of a machine according to the present invention.
FIG. 2 is an end view in the direction of the arrow II in FIG. 1 but with an implement of the machine located in a different attitude.
FIG. 3 is a perspective view, to an enlarged scale, of part of the machine showing the mounting of the rotatable telescopic boom assembly.

Referring firstly to FIGS. 1 and 2, it can be seen that the machine comprises a rotatable telescopic boom assembly 10 mounted on a tracked automobile vehicle 11. The rotatable telescopic boom assembly 10 comprises an outer boom section 12 which is rigidly attached to a mounting foot 13 that is pivotally connected to the vehicle 11, an intermediate boom section 14 which is rotatably mounted within the outer boom section 12, and an inner boom section 15 which is located in a telescopic relationship within the intermediate boom section and has fixed at one end thereof a cradle 16 carrying an implement such as a hydraulic impact hammer 17. The intermediate boom section 14 is rotatably driven by fluid actuator means, as will be described, within the outer boom section 12 and the inner boom section 15 is keyed to the intermediate section 14 to rotate therewith.

The mounting of the rotatable telescopic boom assembly 10 to the vehicle 11 will now be described in more detail with reference to FIG. 3.

The vehicle 11 comprises a conventional excavator vehicle with a pair of driven endless tracks 18 and a cab 19 for an operator. Controls 20 are provided within the cab 19 for operation of the vehicle 11 and the boom assembly 10. Adjacent the cab 19 are located a pair of spaced lugs 21 between which the mounting foot 13 is located and to which the foot 13 is pivotally connected by means of bearings and thrust washers (not shown). In front of the lugs 21, is located a pair of spaced fluid actuated rams 22 attached at one end to the vehicle 11 and at their other end one to each side of the mounting foot 13. By means of the rams 22, the foot 13 can be pivoted and the boom assembly 10 raised and lowered out of a horizontal attitude.

The outer boom section 12 is rigidly attached to the mounting foot 13 by means of a pair of spaced dependent flanges (not shown) which engage within and are bolted to a box formation 23 at the upper end of the foot 13. It will be appreciated that the outer section 12 remains stationary with respect to the foot 13.

Figure 4:
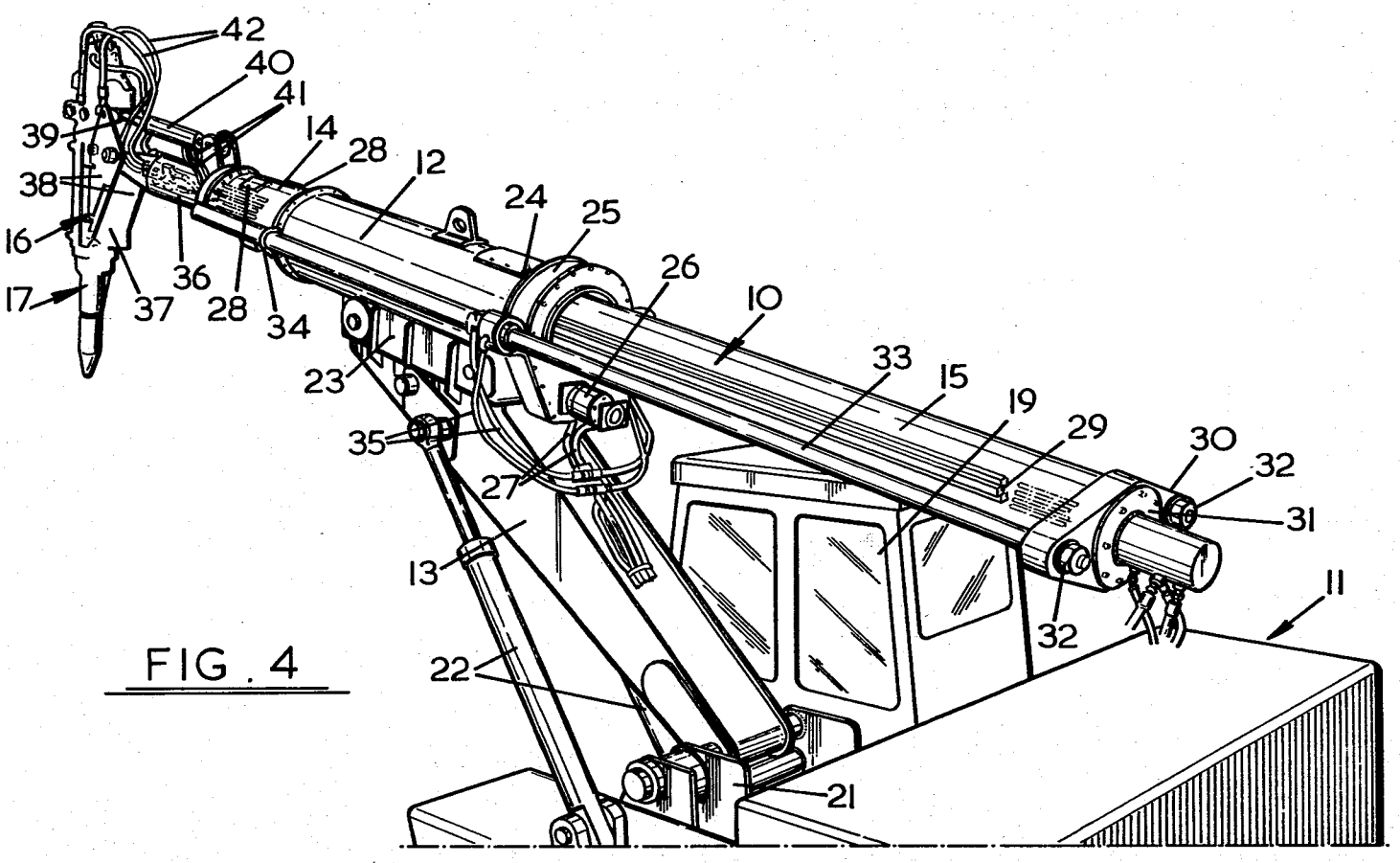
FIG. 4 is a perspective view similar to FIG. 3 but from a different angle showing the rotatable telescopic boom assembly.

Referring now, in addition, to FIG. 4, the intermediate boom section 14 is of smaller diameter than the outer section 12 and is located coaxially within the outer section 12 via bearings (not shown) so that it is free to rotate therein. Attached to a flange 24 at the rear end of the outer section 12 is the casing of a gear box 25. Within the gear box 25, a gear wheel (not shown) is attached to the rear end of the intermediate section 14, which wheel is driven by a fluid motor 26 via a pinion (not shown) to rotate the intermediate section 14. The fluid motor 26 is located at one side of the casing of the gear box 25 and fed with pressurized fluid via hoses 27 from a pump located within the vehicle 11. In this way the intermediate section 14 can be continuously rotated in one direction, such as a clockwise direction when viewed front on as in FIG. 2, through over 360° as required relative to the fixed outer section 12.

The inner boom section 15 is the longest of the three boom sections 12, 14 and 15 and passes coaxially through the intermediate section 15 so as to be reciprocable therethrough. Replaceable bearing pads (not shown) are located between the intermediate and inner sections 14 and 15 to maintain these sections in a correctly spaced relationship and also permit the inner section 15 to move linearly relative to the intermediate section 14. These pads are positioned through apertures formed in the intermediate section 14, which apertures are closed by plates 28. In addition, the inner section 15 is keyed to the intermediate section 14 by means of a pair of slide rails 29 which are attached longitudinally one at each side of the section 15 and which locate in guides attached to the interior of the intermediate section 14.

At the rear end of the inner boom section 15 is positioned a free running flange 30. A bearing arrangement 31 located between the flange 30 and the inner section 15 ensures the free rotation of the latter in the flange 30. The flange 30 has two lateral projecting portions 32 to each of which is attached one end of a fluid actuated ram 33. Each ram 33 lies parallel with the boom sections 12, 14 and 15 and is attached to the boom assembly 10 alongside the outer section 12, apertures being provided in the casing of the gear box 25 through which the rams 33 pass and the front end of the rams 33 being attached by clips 34 to the outer section 12. It will be appreciated, that the rams 33 act together to reciprocate the inner section 15 through the intermediate section 14 and are fed with pressurized fluid as required via hoses 35 from the pump located in the vehicle 11.

The front end of the inner boom section 15 is fixed to the cradle 16 via an extension piece 36 which is rigidly bolted therebetween. The cradle 16 comprises a platform 37 on which the impact hammer 17 is mounted and a pair of depending lugs 38 which are pivotally attached to a further pair of lugs 39 located at the end of the extension piece 36. A fluid actuated ram 40 is positioned between the extension piece 36 and the cradle 16 whereby the cradle 16 and hammer 17 can be pivoted in a vertical plane about the end of boom assembly 10. The ram 40 and the hammer 17 itself are fed with pressurized fluid via hoses 41 and 42 respectively from the pump in the vehicle 11.

The impact hammer 17 can be replaced by many different types of implement, for example, various types of buckets, lifting forks, tines and other forms of hammer, dependent on the job in hand. Various other modifications can also be made to the machine. For example, the boom assembly 10 could be mounted in a fixed location on onto other forms of vehicle and the pivotal mounting foot 13 could be replaced by a fixed mounting.

The machine permits the implement attached thereto to be used with greater accuracy than many conventional machines owing to the combined telescopic and fully rotational boom assembly. This makes the machine suitable for use underground and in locations where access to the area to be worked is difficult.

What is claimed is:

1. A machine comprising a rotatable telescopic boom assembly including an outer boom section, an intermediate boom section rotatably mounted within the outer boom section, and an inner boom section adapted to carry an implement at one end thereof, which inner boom section is located within the intermediate boom section in a telescopic relationship thereto and which is coupled to the intermediate boom section so as to rotate therewith within the outer boom section; a mounting to which the outer boom section is rigidly attached; and fluid pressure actuating means for rotatably driving the intermediate boom section within the outer boom section continuously through 360° in one direction of rotation and for reciprocating the inner boom section within the outer boom section.

2. A machine as claimed in claim 1, in which the fluid pressure actuating means comprise a fluid motor linked to a gear box for rotatably driving the intermediate boom section and a first ram for reciprocating the inner boom section.

3. A machine as claimed in claim 2, in which the gear box is located between the outer boom section and the intermediate boom section.

4. A machine as claimed in claim 2 or 3, in which the ram is located between the outer boom section and a free running flange coupled to the other end of the inner boom section.

5. A machine as claimed in claim 1, in which a cradle is attached to said one end of the inner boom section, which cradle carries the implement.

6. A machine as claimed in claim 5, in which the cradle is pivotally attached to said one end of the inner boom section and a second fluid actuated ram is provided coupled between the cradle and the inner boom section to control movement of the former about the latter.

7. A machine as claimed in claim 1, in which the mounting is pivotally attached to a rigid structure and a third fluid actuated ram is provided between the mounting and the rigid structure to permit the mounting and thereby the boom assembly to be moved in relation to the rigid structure.

8. A machine as claimed in claim 7, in which the rigid structure comprises an automobile vehicle.

9. A machine as claimed in claim 1, in which the implement comprises an impact hammer.

10. A machine as claimed in claim 1, in which the implement comprises a bucket.

11. A machine as claimed in claim 1, in which the implement comprises lifting forks.

12. A machine as claimed in claim 1, in which the implement comprises tines.

* * * * *